US009168649B2

(12) United States Patent
Harcar et al.

(10) Patent No.: US 9,168,649 B2
(45) Date of Patent: Oct. 27, 2015

(54) HAMMER DRILL

(75) Inventors: Frantisek Harcar, Lipany (SK); Andreas Friedrich, Limburg (DE)

(73) Assignee: Black & Decker, Inc., Newark, DE (US)

( * ) Notice: Subject to any disclaimer, the term of this patent is extended or adjusted under 35 U.S.C. 154(b) by 582 days.

(21) Appl. No.: 13/555,489

(22) Filed: Jul. 23, 2012

(65) Prior Publication Data

US 2013/0025897 A1 Jan. 31, 2013

(30) Foreign Application Priority Data

Jul. 26, 2011 (GB) ..... 1112833.7

(51) Int. Cl.
*B25D 17/00* (2006.01)
*B25D 17/04* (2006.01)

(52) U.S. Cl.
CPC ..... *B25D 17/043* (2013.01); *B25D 2222/54* (2013.01); *B25D 2250/371* (2013.01)

(58) Field of Classification Search
CPC ..... B25F 5/006; B25F 5/02; B25C 1/047; B25D 17/00; B25D 17/043; B25G 3/38; B26B 13/28
USPC ..... 173/162.2
See application file for complete search history.

(56) References Cited

U.S. PATENT DOCUMENTS 3,637,029 A * 1/1972 Sherwood et al. ..... 173/162.2
4,478,293 A * 10/1984 Weilenmann ..... B25D 17/043 173/162.2
4,749,049 A * 6/1988 Greppmair ..... 173/162.2
5,375,666 A * 12/1994 Pettet et al. ..... 173/162.1
5,692,574 A * 12/1997 Terada ..... 173/162.2
5,697,456 A * 12/1997 Radle et al. ..... 173/162.2
6,076,616 A * 6/2000 Kramp et al. ..... 173/162.2
6,148,930 A 11/2000 Berger
6,286,610 B1 * 9/2001 Berger et al. ..... 173/162.1
6,309,183 B1 * 10/2001 Bucher et al. ..... 416/210 R
6,863,499 B2 * 3/2005 Pearce ..... 416/210 R
6,935,842 B2 * 8/2005 Tai ..... 416/210 R
7,591,325 B2 * 9/2009 Robieu ..... 173/162.2
7,850,055 B2 * 12/2010 Niblett et al. ..... 227/156
7,921,935 B2 * 4/2011 Engelfried et al. ..... 173/162.2
7,967,079 B2 * 6/2011 Stierle et al. ..... 173/216
8,061,438 B2 * 11/2011 Schmid et al. ..... 173/162.2
8,069,930 B2 * 12/2011 Engelfried ..... 173/162.2
8,240,395 B2 * 8/2012 Kamegai et al. ..... 173/162.2
2005/0095135 A1 * 5/2005 Bucher et al. ..... 416/210 R
2005/0224244 A1 * 10/2005 Kraenzler et al. ..... 173/162.1
2006/0086515 A1 * 4/2006 Engelfried ..... 173/162.2

(Continued)

FOREIGN PATENT DOCUMENTS

EP 1529603 7/2007
EP 1157788 12/2008

(Continued)

*Primary Examiner* — Robert Long
(74) *Attorney, Agent, or Firm* — Adan Ayala

(57) ABSTRACT

A hammer-drill including a body in which is mounted a motor and a hammer mechanism which is driven by the motor; a tool holder mounted on the front of the body and which is capable of holding a cutting tool, the hammer mechanism being capable of imparting impacts to the cutting tool, when held by the tool holder; a rear handle, moveably mounted onto the rear of the body via at least one movement control mechanism and which is capable of moving towards or away from the body; a biasing mechanism which biases the rear handle away from the body.

5 Claims, 6 Drawing Sheets

(56) References Cited

U.S. PATENT DOCUMENTS

| | | | | |
|---|---|---|---|---|
| 2006/0113098 | A1* | 6/2006 | Inagawa et al. | 173/162.2 |
| 2006/0219418 | A1* | 10/2006 | Arakawa et al. | 173/162.2 |
| 2006/0289183 | A1* | 12/2006 | Schreiber | 173/162.2 |
| 2007/0212990 | A1* | 9/2007 | Kuragano | B25F 5/006 451/359 |
| 2007/0289762 | A1* | 12/2007 | Kikukchi et al. | 173/162.1 |
| 2007/0295521 | A1* | 12/2007 | Wiker et al. | 173/162.1 |
| 2008/0022817 | A1 | 1/2008 | Fischer | |
| 2009/0266571 | A1* | 10/2009 | Baumann et al. | 173/162.2 |
| 2009/0294144 | A1* | 12/2009 | Frauhammer et al. | 173/162.2 |
| 2010/0012339 | A1* | 1/2010 | Hahn et al. | 173/162.2 |
| 2010/0186979 | A1* | 7/2010 | Krauter et al. | 173/162.2 |
| 2010/0193209 | A1* | 8/2010 | Schadow et al. | 173/162.2 |
| 2010/0193210 | A1* | 8/2010 | Krauter et al. | 173/171 |
| 2010/0206596 | A1* | 8/2010 | Kamegai et al. | 173/162.2 |
| 2011/0011608 | A1* | 1/2011 | Saur | 173/162.2 |
| 2012/0031639 | A1* | 2/2012 | Roberts et al. | 173/162.2 |

FOREIGN PATENT DOCUMENTS

| | | |
|---|---|---|
| EP | 2018938 | 1/2009 |
| EP | 2082845 | 7/2009 |
| EP | 2289669 | 3/2011 |

* cited by examiner

HAMMER DRILL

CROSS-REFERENCE TO RELATED APPLICATIONS

This application claims priority, under 35 U.S.C. §119(a)-(d), to UK Patent Application No. GB 11 128 33.7 filed Jul. 26, 2011, the contents of which are incorporated herein by reference in their entirety.

FIELD OF THE INVENTION

The present invention relates to a hammer drill, and in particular, a vibration dampening mechanism for a handle of a hammer drill.

BACKGROUND OF THE INVENTION

A typical hammer drill comprises a body in which is mounted an electric motor and a hammer mechanism. A tool holder is mounted on the front of the body which holds a cutting tool, such as a drill bit or a chisel. The hammer mechanism typically comprises a slideable ram reciprocatingly driven by a piston, the piston being reciprocatingly driven by the motor via a set of gears and a crank mechanism or wobble bearing. The ram repeatedly strikes the end of the cutting tool via a beat piece. When the only action on the tool bit is the repetitive striking of its end by the beat piece, the hammer drill is operating in a hammer only mode.

Certain types of hammer drill also comprise a rotary drive mechanism which enables the tool holder to rotatingly drive the cutting tool held within the tool holder. This can be in addition to the repetitive striking of the end of the cutting tool by the beat piece (in which case, the hammer drill is operating in a hammer and drill mode) or as an alternative to the repetitive striking of the end of the cutting tool by the beat piece (in which case, the hammer drill is operating in a drill only mode).

EP1157788 discloses a typical hammer drill.

Hammer drills are supported by the operator using handles. In one type of hammer drill, there is one rear handle attached to the rear of the body of the hammer drill, at the opposite end of the body to where the tool holder is mounted. The operator pushes the cutting tool into a work piece by pushing the rear handle towards the body, which in turn pushes the body and the cutting tool towards the work piece.

A problem associated with hammer drills is the vibration generated by the operation of the hammer drill, and in particular, the vibration generated by the operation of the hammer mechanism. This vibration is transferred to the hands of the operator holding the handles of the hammer drill, particularly through the rear handle. This can result in the injury of the hands of the operator. As such, it is desirable to minimise the effect of vibration experienced by the hands of the operator. This is achieved by reducing the amount by which the handle vibrates.

There are at least two ways of reducing the amount by which the rear handle vibrates. The first method is to reduce the amount of vibration produced by the whole hammer drill. The second method is to reduce the amount of vibration transferred from the body of the hammer drill to the rear handle. The present invention relates to the second method.

EP1529603 discloses a dampening mechanism for a rear handle by which the amount of vibration transferred from the body to the handle is reduced.

The rear handle is slideably mounted on the body using connectors 230. Springs 220 bias the handle 202 rearwardly away from the housing 212, and which act to dampen vibration to reduce the amount transferred from the housing 212 to the handle 202. A movement co-ordination mechanism is provided, which comprises an axial 216, which interacts with the connectors 230 to ensure that the movement of the two ends of the handle are in unison.

The problem with the design of dampening mechanism disclosed in EP1529603 is that the movement co-ordination mechanism is located within the housing. As such, it takes up valuable space.

EP2018938 seeks to overcome this problem by placing the movement co-ordination mechanism in the handle.

However, in both EP1529603 and EP2018938, the designs of handle require a movement co-ordination mechanism which incurs extra cost and complexity.

In EP152603, there are provided two bars (230*a*, 230*b*) connected to the handle which slide within guides (232*a*, 232*b*) mounted on the housing. In EP2018938, there are provided two bars (24; 104) connected to the housing which slide within guides (26) mounted on the handle. In both designs, the amount of contact in the lengthwise direction between the bars and the guides remain constant at all times. The amount of contact is dependent on the length of the guide. This is regardless of the position of the handle versus the housing. As such, the amount of support for the bars against a bending force applied to the bars remains constant regardless of the amount of force applied to the handle to move it towards the housing. Only the position of the guides on the bars alters as the handle moves relative to the housing.

Furthermore, the guides are shown as making contact along the whole length of the part of the bars located inside of the guides. However, in reality, the inner surfaces of the guide and the external surfaces formed on the bar are not perfectly flat due to manufacturing tolerances and wear. Therefore, to ensure that the bars slide smoothly within the guides, the dimensions of the cross section of the bars are slightly less than that of the cross section of the passageways formed through the guides. This however, allows the bars to move by a small amount in a direction perpendicular to its longitudinal axis within the guide. This allows the handle to move sideways thus increasing the amount of vibration transferred to the handle.

EP 2289669 discloses a hammer drill in which a rear handle is moveably mounted on to the rear of a body via at least one movement control mechanism and which is capable of moving towards or away from the body, wherein each movement control mechanism comprises a first mount, a rod, having a longitudinal axis, rigidly connected at one of it ends to the first mount, and a second mount which slidingly engages with the rod at two distinct points only along its length to allow the rod to slide relative to the second mount in a direction parallel to the longitudinal axis whilst preventing the rod from moving relative to second mount in a direction perpendicular to longitudinal axis, wherein one mount is attached to the body and the other mount is attached to the rear handle.

As there are only two distinct points of contact, there is no contact between the rod and the second mount any where else. It will be appreciated that at each of the two points where they slidingly connect, a part of the second mount can slide along a part of the rod or that part of the rod can slide along a part of the second mount.

The use of two distinct points of contact only ensures that a good contact can be made with the rod at theses points in order to provide a strong sideways support for the rod against a bending force acting on the rod, thus preventing any sideways movement of the rod.

BRIEF SUMMARY OF THE INVENTION

Preferred embodiments of the present invention seek to further improve the vibration damping properties of the hammer drill.

According to the present invention, there is provided a power tool comprising:— a housing;

a tool holder mounted to the housing for holding a cutting tool;

a hammer mechanism in the housing for imparting impacts to a cutting tool held by the tool holder;

a motor in the housing for driving the hammer mechanism;

a rear handle moveably mounted to a rear of the housing by means of at least one movement control mechanism comprising a respective first part mounted to one of the rear handle and housing, and a respective second part mounted to the other of the rear handle and housing and adapted to slidingly engage said first part at two separate locations thereon as said rear handle moves relative to said housing along a sliding direction; and at least one biasing device for biasing the rear handle away from the housing;

wherein at least one said second part includes a respective support member adapted to engage said first part at one of said locations thereon, and limited movement of said first part relative to said one of said rear handle and said housing to which said support member is mounted is permitted in at least one direction transverse to said sliding direction.

By permitting limited movement of said first part relative to said one of said rear handle and said housing to which said support member is mounted in at least one direction transverse to said sliding direction, this provides the surprising advantage of significant further enhancement of the vibration damping properties of the tool.

At least one said support member may be adapted to be resiliently deformed to permit said limited movement of said first part relative to said one of said rear handle and said housing to which said support member is mounted.

By causing resilient deformation of the support member, this provides the advantage of further enhancing the vibration damping properties of the tool.

At least one said support member may comprise a respective first portion adapted to engage said first part at said one of said locations thereon, and a respective second portion for engaging said one of said rear handle and said housing to which said support member is mounted.

This provides the advantage of enabling deformation of a larger proportion of the support member as a result of separation of the locations at which the support member engages the first part and said one of said rear handle and said housing to which the support member is mounted, which further enhances the vibration damping properties.

A respective periphery of at least one said second portion may be adapted to engage a respective recess on said one of said rear handle and said housing to which said support member is mounted.

At least one said support member may comprise a respective body portion having at least one respective slot along part of said body portion.

This provides the advantage of enabling the dimensions of the part of the body portion where the slot is absent to be maintained, in order to enable the body portion to effectively engage said one of said rear handle and said housing to which the support member is mounted, while enabling flexing of the part of the body portion where the slot is present.

At least one gap may be provided between the support member and said one of the rear handle and the housing to which the support member is mounted.

BRIEF DESCRIPTION OF THE DRAWINGS

A preferred embodiment of the invention will now be described, by way of example only and not in any limitative sense, with reference to the accompanying drawings, in which:—

DETAILED DESCRIPTION OF THE INVENTION

Figure 1:
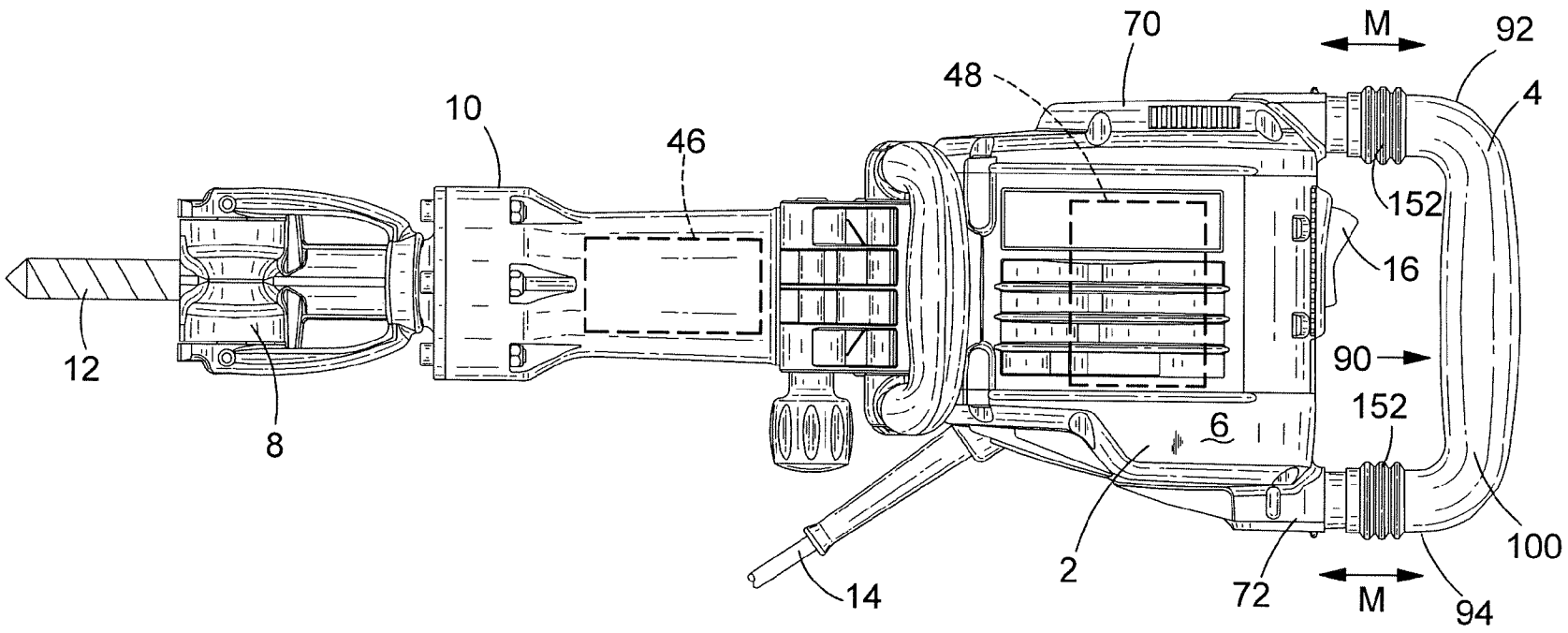
FIG. 1 shows a sketch of a side view of a hammer drill embodying the present invention.

Referring to FIG. 1, the hammer drill comprises a body 2 having a rear handle 4 moveably mounted to the rear of the body 2. The rear handle 4 comprises a centre grip section 90 and two end connection sections 92; 94, one end connection section being attached to one end of the centre grip section, the other end connection section being connected to the other end of the centre grip section. The handle 4 is connected to the rear of the body 2 by the two end connection sections 92, 94. The rear handle is constructed from a plastic clam shell 100. The rear of the body is formed by three plastic clam shells 6, 70, 72 which attach to each other and to the remainder of the body 2 using screws (not shown).

A tool holder 8 is mounted onto the front 10 of the body 2. The tool holder can hold a cutting tool 12, such as a drill bit. A motor (shown generally by dashed lines 48) is mounted within the body 2 which is powered by a mains electricity supply via a cable 14. A switch 16 is mounted on the rear handle 4. Depression of the switch 16 activates the motor in the normal manner. The motor drives a hammer mechanism (shown generally by dashed lines 46), which comprises a ram (not shown) reciprocatingly driven by the motor within a cylinder (not shown) which in turn strikes, via a beat piece (not shown), the end of the cutting tool 12.

The rear handle 4 can move in the direction of Arrow M in FIG. 1. The movement of handle 4 is controlled using two movement control mechanisms, as described below, so that it moves linearly towards or away from the body 2 of the hammer drill, but rotation of the handle 4 relative to the body 2 of the hammer drill is significantly restricted. Two helical springs 104 (FIG. 2) bias the rear handle 4 away from the body 2.

The two movement control mechanisms will now be described with reference to FIGS. 2 to 8. Each movement control mechanism is identical to the other movement control mechanism. As such, a single description of a movement control mechanism will be provided but is equally applicable to either of the two movement control mechanisms.

Each movement control mechanism comprises a metal tube 106 of circular cross section and with a smooth outer surface, one end of which located with a correspondingly shaped recess 108 formed in the clam shell 100 of the rear handle 4. A plastic plug 110 comprises an elongate body 112 of circular cross section with a head 114, having a coffin shaped cross section (see FIG. 5), attached to one end. The outer diameter of the elongate body 112 is the same as the inner diameter of the tube 106. The head 114 has dimensions which are greater than the inner diameter of the tube 106. The elongate body 112 is slid inside the free end of the tube 106 remote from the handle 4 until the head 114 is located adjacent the free end as shown in the Figures.

A hole 109 is formed through the base of the recess 108 which extends through to a cut out 118 formed in the rear of the clam shell 100 of the handle 4. A threaded shaft 116 of a bolt passes through a metal washer 120 located in the cut out 118, through the hole 109, through the length of the tube 106 and screws into a threaded bore 122 formed in the elongate body 112 of the plug 110. The head 124 of the bolt locates against the washer 120 in the cut out 118. The bolt rigidly secures the plug 110 to the tube 106 and the tube to the clam shell 100 of the rear handle 4.

Two of the clam shells 70, 72 which form the rear of the body 2 each have a recess formed in two sections, a front section 126 and a rear section 128 separated by an annular ridge 130. Each recess forms a part of one of the movement control mechanisms.

Figure 2:
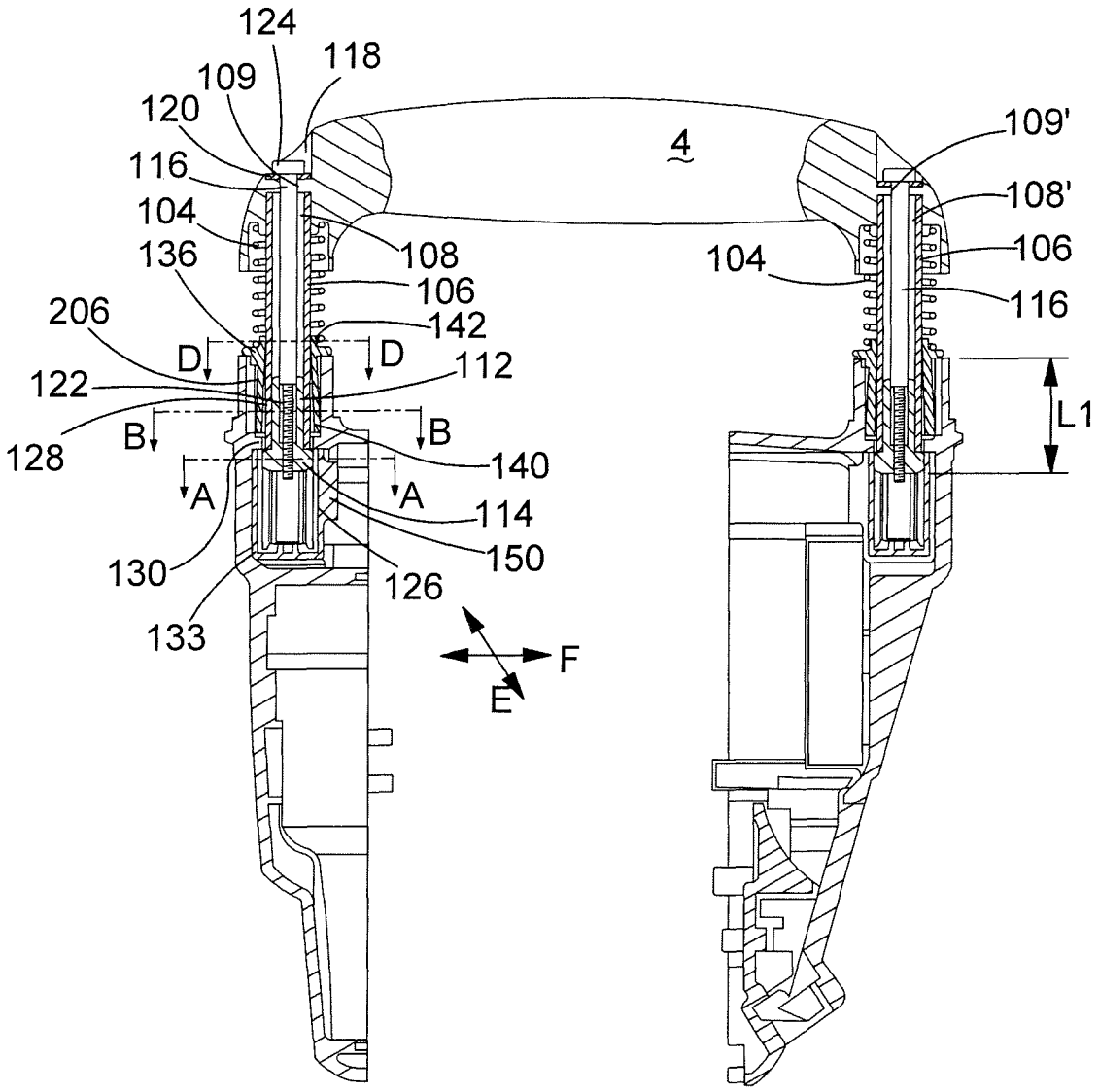
FIG. 2 shows a vertical cross section of a rear handle assembly of the hammer drill of FIG. 1 when a handle therefore is biased away from a body thereof by the maximum amount.
Figure 3:
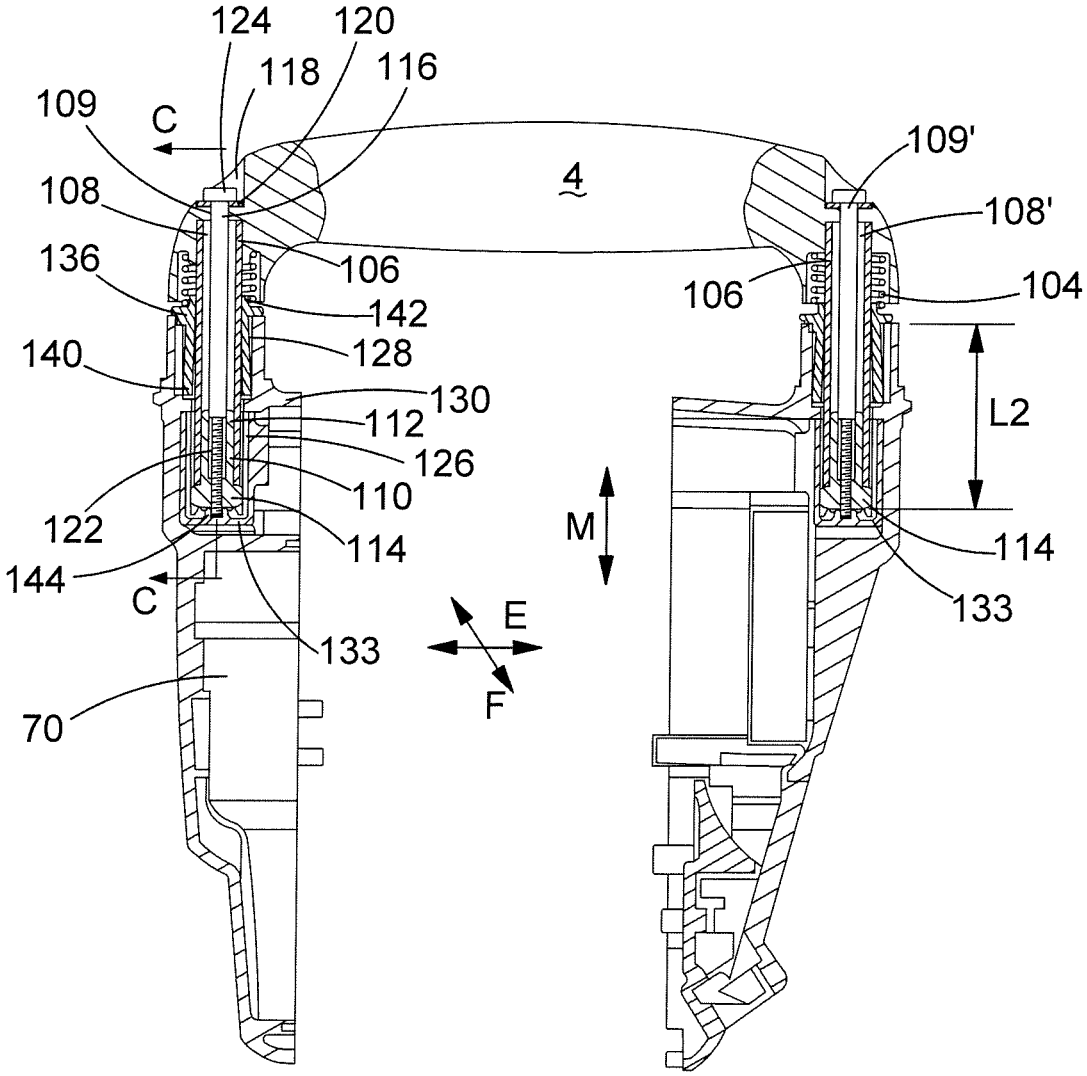
FIG. 3 shows a vertical cross section of the rear handle assembly shown in FIG. 2 when the handle is moved to its closest position to the body against the biasing force of the springs.
Figure 4:
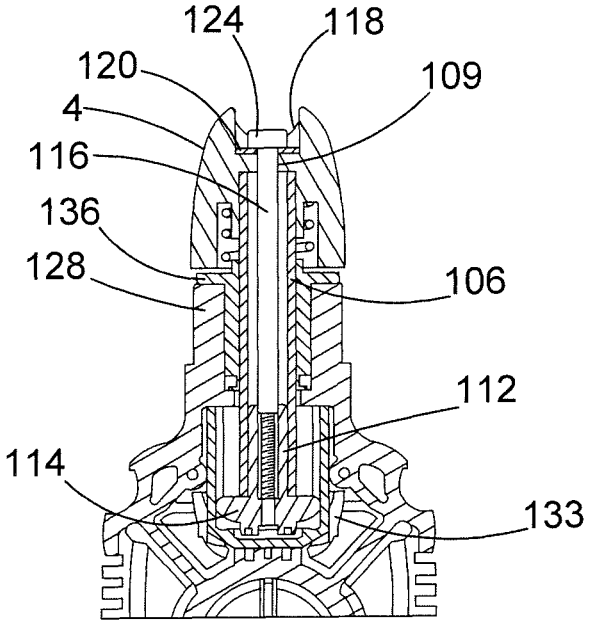
FIG. 4 is a cross section view in the direction of Arrows C in FIG. 3.
Figure 5:
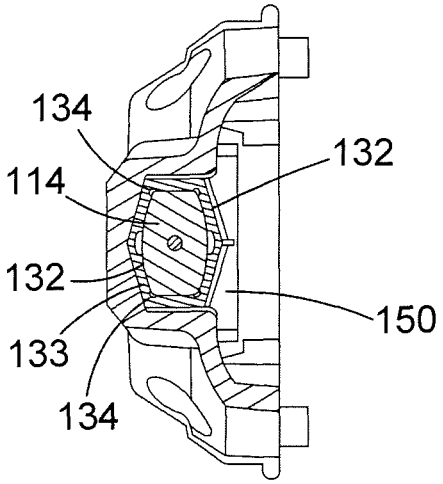
FIG. 5 is a cross section view in the direction of Arrows A in FIG. 2.
Figure 6:
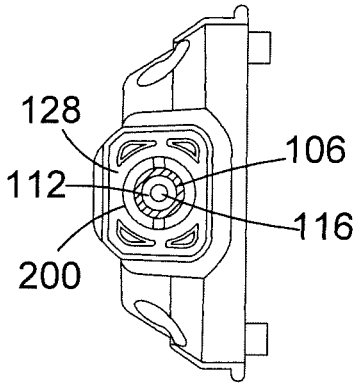
FIG. 6 is a cross section view in the direction of Arrows B in FIG. 2.
Figure 7:
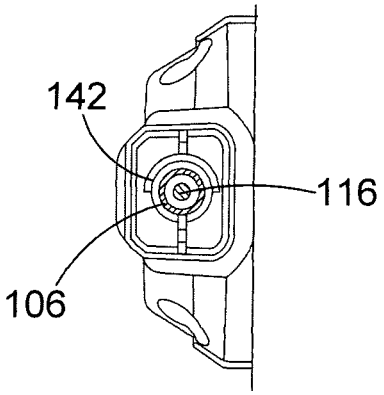
FIG. 7 is a cross section view in the direction of Arrows D in FIG. 2.
Figure 8:
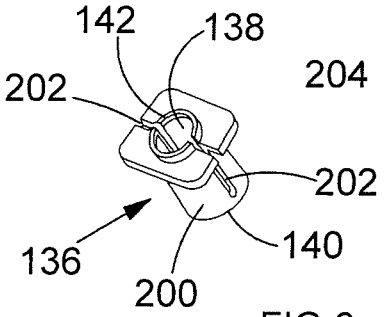
FIG. 8 is a perspective view of an insert of the handle assembly of FIG. 2.

Located in the front section 126 of each recess is a first rigid plastic tubular insert 133 which has a tubular passage within it which is coffin shaped in cross section along its length as shown in FIG. 5. The tubular insert 133 is held in place in the clam shell 70, 72 by means of a plastic cover 150 which is attached to the clam shell 70, 72 using screws (not shown). The dimensions of the cross sectional shape of the tubular passage correspond to that of the head 114. The head 114 locates inside of the insert 133 and is capable of sliding from the rear end (FIG. 2) of the tubular passage, along the length of the passage, to the front end (FIG. 3). Along the inside walls of the tubular passage are platforms 132 (FIG. 5) which extend lengthwise within the tubular passage and which slidingly engage with the sides of the head 114 of the plastic plug 110 to support the head 114. These provide a defined contact area between the insert 133 and head 114 along which the head 114 slides. Thus no gaps are left between the head 114 and the platforms 132, thus preventing any sideways movement (in the direction of Arrows E and F in FIGS. 2 and 3) of the head 114 in the first tubular insert 133. This also guarantees a smooth sliding action between the head and the insert 133. The platforms also reduce the size of the area of contact between the head 114 and the insert 133, thus reducing the frictional contact. The platforms 132 also produce air passageways 134 between the platforms 132, the inner walls of the insert 133 and the head 114. This allows air to travel around the head 114 as it slides backward and forwards inside the tubular passage.

Figure 9A:
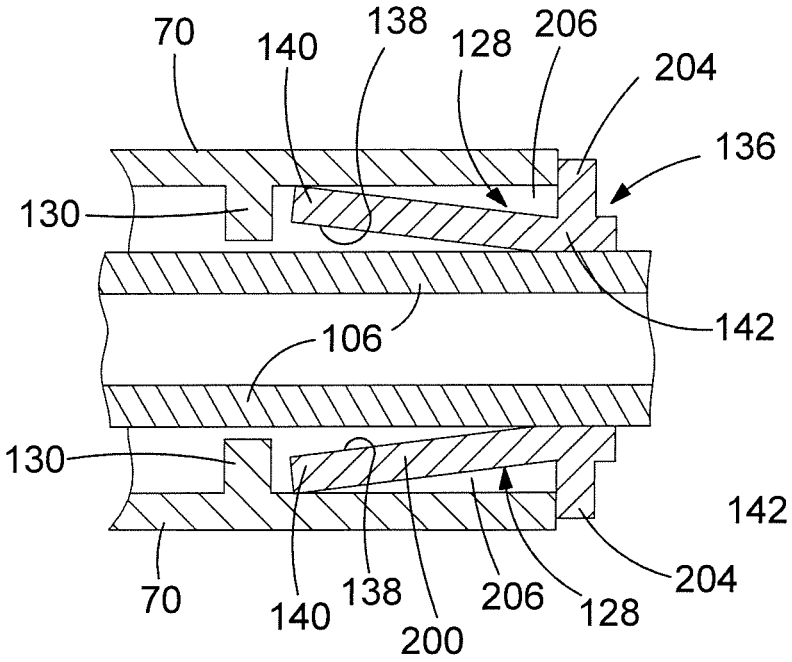
FIG. 9A shows a schematic diagram of the insert and tube located within the rear section 128 when no sideways (Arrows E and F) load is exerted on the tube.

Located in the rear section 128 of each recess is a second rigid plastic tubular insert 136. As shown in greater detail in FIGS. 8 and 9A, the insert 136 has a tapering body portion 200 of uniform thickness defining an inner surface 138 of circular cross section. The body portion 200 has a pair of slots 202 arranged along the majority of its length and a flange 204 at one end. The body portion 200 tapers, in a lengthwise direction, from a narrow cross section 142 at the rear end to a larger cross section 140 at the front end. The part of the insert 136 with the smallest cross section area 142 has the same dimensions as that of the outer diameter of the tube 106 and slidingly engages with the smooth outer surface of tube 106.

The external dimension of the larger cross section part 140 is the same as the internal dimension of the internal part of the rear section 128 of the recess, such that the insert 136 has an interference fit in the rear section 128 of the recess, and the flange 204 abuts the end of the rear section 128 of the recess such that a small gap 206 is formed between the outer surface of the insert 136 and the inner surface of the rear section 128 of the recess. This allows limited movement of the insert 136 relative to the rear section 128 of the recess in the direction of arrows E and F in FIGS. 2 and 3 as a result of bending of the insert 136.

Figure 9B:
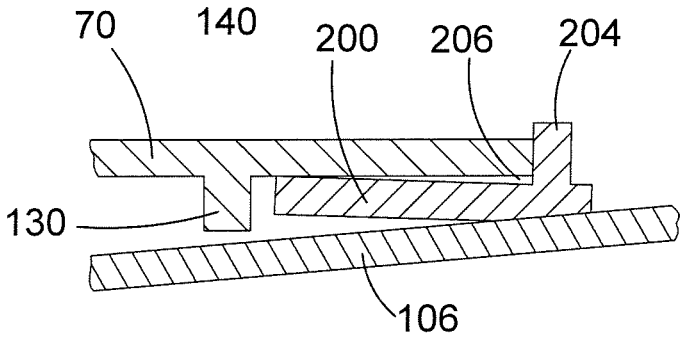
FIG. 9B shows a schematic diagram of one side of insert and tube located within the rear section 128 when the insert is deformed along its length to allow sideways (Arrows E and F) movement of the tube.

Because the part of the insert 136 with the smallest cross section area 142 has the same dimensions as that of the outer diameter of the tube 106 and slidingly engages with the smooth outer surface of tube 106, this ensures that the only part of the insert 136 which engages the tube is the rear part 142. As such, a flush contact is made between the insert 136 and the side of the tube 106 at a single point along the length of the tube. Therefore, the only sideways movement of the tube 106 relative the rear section 128 of the recess in a direction (Arrows E or F) perpendicular to the longitudinal axis 107 of the tube 106 is as a result of deformation of the insert 136 which bends along its length to move into the gap 206 between the insert 136 and the rear section 128 of the recess as shown in FIG. 9B.

The only connection between the tube 106 and the body 2 is at two points only along the length of the tune 106. The connection points are formed via the inserts 133, 136. The first connection point is via the side of the head 114 engaging with the platforms 132 on the inner walls of the first tubular insert 133. The second connection point is via the side of the tube 106 engaging the part 142 of the second tubular insert 136 having the smallest cross section. In between these two points, there is no contact between the tube 106 and the inserts 133, 136 or the clam shells 70, 72. Such a construction ensures that the movement of the handle 4 is almost entirely linear, in a direction parallel to the longitudinal axis 107 of the tube 106, with limited sideways movement of the handle 4 in the direction of Arrows E or F. As there are two movement control mechanisms, the handle 4 is largely prevented from rotation about the longitudinal axis 107 of either of the tubes 106 of the two movement control mechanisms. As such, the movement of the handle 4 is almost totally linear with only limited rotation relative to the body 2.

Sandwiched between the clam shell 100 of the handle 4 and the clam shell 70, 72 of the body 2 and surrounding the tube 106 is a helical spring 104. The helical spring biases the handle away from the body 2. During the use of the hammer, the springs of the two movement control mechanisms absorb vibration from the body 2, reducing the amount transferred from the body 2 to the handle 4. Bellows 152 surround the spring 104 and the tube 106 and connect between the clam shell 100 of the handle 4 and the clam shell 70, 72 of the rear of the body 2 to prevent the ingress of dust during use of the hammer.

Located inside the first tubular insert 133 at the forward end of the tubular passage is a resilient cushion 144 made of rubber material. When the handle 4 is pushed towards the body 2 to its inner most position (see FIG. 3), the head 114 engages with the cushion 144, preventing the head 114 from moving further forward. The cushion 144 also damps any vibration which would otherwise be transmitted from the insert to the head 144.

It should be noted that there is a slight difference in designs for the recess 108 and the hole 109 for the two movement control mechanisms. Referring to FIG. 2, the recess 108 and the and the hole 109 of the top movement control mechanism as viewed, are circular in cross section. This ensures that the position of the tube 106 and/or the shaft 116 of the bolt, in a direction perpendicular to their longitudinal axes 107, relative to the clam shell 100 of the handle 4 is fixed. However, the recess 108' and the and the hole 109' of the lower movement control mechanism as viewed in FIG. 2, are oval in cross section, with the longer axis of the oval being vertical (a small gap is visible in FIG. 2). This allows the position of the tube 106 and/or the shaft 116 of the bolt, in a vertical direction, to be varied relative to the shell 100 of the handle 4. This is to accommodate manufacturing tolerances of the clam shell 100 which result in small variations in the length of the shell. The oval recess 108' and hole 109' allow the tube 106 and the bolt of the lower movement control mechanism to locate in positions within the recess 108' and hole 109' where there are no bending stress (in the direction of Arrows E or F) on the tube 106 and bolt. This in turn prevents there being any bending stresses (in the direction of Arrows E or F) on the tube 106 and bolt of the top movement control mechanism. Once these positions in the recess 108' and hole 109' for the tube 106 and bolt have been obtained, they are fixed relative to the shell 100 by screwing the bolt tightly into the threaded bore 122 of the plug 110. This allows for a precise contact between the heads 114 of the plugs 110 and the platforms 132 of the first tubular inserts 133, and the narrowest point 142 of the second tubular insert 136 and the tube 106 of both of the movement control mechanisms, thus allowing a smooth sliding action.

The operation of the movement control mechanisms will now be described.

When the hammer drill is not being used, the handle is biased away from the body 2 under the influence of the two helical springs 104 to the position shown in FIG. 2. In this position, the heads 114 of the plugs 110 are located at the rear most position of the first tubular inserts 133. Each tube 106 is supported at two points, namely, the point where the part 142 of the second tubular insert 136 having the smallest cross section engages the side of the tube 106 and the point where the head 114 of the plug 110 engages the inner walls of the rear most part of the tubular passage of the first tubular insert 133. The distance between these two points is L1.

When an operator commences to use the hammer drill, the operator supports it with the rear handle and applies a pressure on the handle 4, pushing it towards the body 2 against the biasing force off the springs 104. As the handle 4 moves towards the body 2, each tube 106 slides axially into the body 2. As it does so, the head 114 of each plug 110 slides forward inside of the first tubular insert 133 towards the cushion 144. As it does so, each tube 106 slides through the second tubular insert 136, the part 142 of the second tubular insert 136 having the smallest cross section sliding along the side of the tube 106 as it does so. It should be noted the two movement control mechanism operate in unison.

The platforms 132 on the inner wall of the first tubular insert, which provide a defined contact area between the insert 133 and head 114 along which the head 114 slides, enables relative sliding action between the head and the insert 133 to be smooth and prevents the head from jamming inside of the first tubular insert 133.

As the outer surface of the tube is smooth, the sliding movement of the part 142 of the second tubular insert 136 having the smallest cross section along the side of the tube 106 is smooth.

Any vibration generated by the operation of the hammer is damped by the helical springs 104. The smooth sliding action between the head 114 and the insert 133, due to the platforms 132, and the tube 106 and the second tubular insert 136, maximizes the damping efficiency of the springs 104. It is found that limited sideways movement of the inserts 136 in the direction of Arrows E or F relative to the rear section 128 of the recess in the housing significantly enhances vibration damping compared to an arrangement in which no such sideways relative movement is possible.

No other connection is made between the tube 106 and the inserts 133, 136 other than via the side of the head 114 engaging with the platforms 132 on the inner walls of the first tubular insert 133 and via the side of the tube 106 engaging the part 142 of the second tubular insert 136 having the smallest cross section, as the tube slides into the body 2.

As the tube slides into the body, the distance between the two points, namely, the point where the part 142 of the second tubular insert 136 having the smallest cross section engages the side of the tube 106 and the point where the head 114 of the plug 110 engages the inner wall of the rear most part of the tubular passage of the first tubular insert 133, increases.

When the operator has applied the maximum pressure to the handle 4, the head 114 of the plug 110 is located at the fore most position of the first tubular insert 133 adjacent the cushion 144 as shown in FIG. 3. The distance between these two support points is L2. The head 114 engages with the cushion is prevented from moving any further inside of the first tubular insert 133.

As can be seen in FIGS. 1 and 2, the distance L2 is greater than L1. This has the advantage that, as the pressure applied by the operator on the handle during use increases, the distance between the support points along the length of the tube 106 increases, providing an increasing amount of support to the tube 106 against bending forces (in the direction of Arrows E or F). As such, it provides a wider support structure to the tube 106. When the maximum pressure is applied to the handle, the two support points are the maximum distance part, providing the greatest support to the tube 106 against bending. However, the use of an insert 136 which is tapered along the length of its body 200 and is able to bend sideways within the rear section 128 allows limited sideways movement of the tube 106 within the rear section thus providing some vibration dampening in the direction of Arrows E and F.

It will be appreciated by persons skilled in the art that the above embodiment has been described by way of example only and not in any limitative sense, and that various alterations and modifications are possible without departure from the scope of the invention as defined by the appended claims.

The invention claimed is:

1. A power tool comprising:

a housing;

a tool holder mounted to the housing for holding a cutting tool;

a hammer mechanism in the housing for imparting impacts to a cutting tool held by the tool holder;

a motor in the housing for driving the hammer mechanism;

a rear handle, moveably mounted to a rear of the housing distal from the tool holder;

at least one movement control mechanism coupling the rear handle and the rear of the housing, the at least one movement control mechanism comprising a respective first part mounted to one of the rear handle and the rear of the housing, and a respective second part mounted to the other of the rear handle and the rear of the housing, the second part and adapted to slidingly engage said first part at two separate locations thereon as said rear handle moves relative to said housing along a sliding direction; and at least one biasing device for biasing the rear handle away from the housing;

wherein at least one said second part includes a respective support member adapted to engage said first part at one of said locations thereon, and limited movement of said first part relative to said one of said rear handle and said housing to which said support member is mounted is permitted in at least one direction transverse to said sliding direction;

wherein the support member extends in the sliding direction from a first portion of the support member to a second portion of the support member, where the first portion is sized to remain in contact with the first part through relative movement in said sliding direction, while the second portion extends away from the first part, creating a gap between the first part and a portion of the support member which may close during said limited movement in the at least one direction transverse to said sliding direction;

the support member comprising a body portion having first and second portions and a slot, wherein the first portion of the body portion is a narrow cross section portion, and the second portion of the body portion is a larger cross section portion, where an inner diameter at the narrow cross section portion corresponds with an outer diameter of the first part.

2. The power tool of claim 1, wherein at least one said support member is adapted to be resiliently deformed to permit said limited movement of said first part relative to said one of said rear handle and said housing to which said support member is mounted.

3. The power tool of claim 2, wherein at least one said support member comprises a respective first portion adapted to engage said first part at said one of said locations thereon, and a respective second portion for engaging said one of said rear handle and said housing to which said support member is mounted.

4. The power tool of claim 3, wherein a respective periphery of at least one said second portion is adapted to engage a respective recess on said one of said rear handle and said housing to which said support member is mounted.

5. The power tool of claim 1, wherein at least one gap is provided between the support member and said one of the rear handle and the housing to which the support member is mounted.

* * * * *